US008584759B2

(12) United States Patent
O'Malley et al.

(10) Patent No.: US 8,584,759 B2
(45) Date of Patent: Nov. 19, 2013

(54) HYDRAULIC FRACTURE DIVERTER APPARATUS AND METHOD THEREOF

(75) Inventors: Edward J. O'Malley, Houston, TX (US); Matthew D. Solfronk, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 363 days.

(21) Appl. No.: 13/050,586

(22) Filed: Mar. 17, 2011

(65) Prior Publication Data

US 2012/0234547 A1 Sep. 20, 2012

(51) Int. Cl.
*E21B 43/26* (2006.01)
*E21B 33/126* (2006.01)

(52) U.S. Cl.
USPC ..... 166/308.1; 166/177.5; 166/195; 166/202; 166/387

(58) Field of Classification Search
USPC ..... 166/308.1, 387, 195, 202, 177.5
See application file for complete search history.

(56) References Cited

U.S. PATENT DOCUMENTS

| | | | | |
|---|---|---|---|---|
| 4,356,865 | A | 11/1982 | Appel et al. | |
| 5,261,487 | A * | 11/1993 | McLeod et al. | 166/85.3 |
| 5,944,446 | A | 8/1999 | Hocking | |
| 6,918,441 | B2 * | 7/2005 | Dallas | 166/202 |
| 7,004,260 | B2 * | 2/2006 | Bosma et al. | 166/387 |
| 7,077,214 | B2 * | 7/2006 | Vincent et al. | 166/387 |
| 7,216,706 | B2 * | 5/2007 | Echols et al. | 166/285 |
| 7,264,047 | B2 * | 9/2007 | Brezinski et al. | 166/202 |
| 7,278,477 | B2 * | 10/2007 | McGuire et al. | 166/202 |
| 7,299,882 | B2 * | 11/2007 | Brezinski et al. | 166/387 |
| 7,320,367 | B2 * | 1/2008 | Brezinski et al. | 166/387 |
| 7,363,986 | B2 * | 4/2008 | Brezinski et al. | 166/387 |
| 7,380,592 | B2 | 6/2008 | Atkins et al. | |
| 7,434,617 | B2 * | 10/2008 | Artherholt | 166/202 |
| 7,552,769 | B2 * | 6/2009 | Cherewyk | 166/202 |
| 7,562,705 | B2 * | 7/2009 | Cherewyk | 166/202 |
| RE41,118 | E * | 2/2010 | Brezinski et al. | 166/387 |
| 7,669,654 | B2 * | 3/2010 | Artherholt | 166/202 |
| 7,708,061 | B2 * | 5/2010 | McGuire et al. | 166/202 |
| 7,730,941 | B2 * | 6/2010 | Abarca et al. | 166/207 |
| 2004/0055758 | A1 * | 3/2004 | Brezinski et al. | 166/384 |
| 2004/0182582 | A1 * | 9/2004 | Bosma et al. | 166/387 |
| 2004/0256115 | A1 * | 12/2004 | Vincent et al. | 166/387 |
| 2005/0023003 | A1 * | 2/2005 | Echols et al. | 166/384 |
| 2006/0090904 | A1 * | 5/2006 | McGuire et al. | 166/387 |
| 2007/0158061 | A1 * | 7/2007 | Casey | 166/68 |
| 2007/0267201 | A1 * | 11/2007 | Brezinski et al. | 166/387 |
| 2012/0234547 | A1 * | 9/2012 | O'Malley et al. | 166/308.1 |

OTHER PUBLICATIONS

Clem et al. "A Pragmatic Approach to Frac-Pack Tool Erosion Qualification Testing," SPE Annual Technical Conference and Exhibition, Sep. 19-22, 2010, Florence, Italy. [Abstract and Introduction Only].

Kundert, Donald and Mike Mullen. "Proper Evaluation of Shale Gas Reservoirs Leads to a More Effective Hydraulic-Fracture Stimulation." SPE Rocky Mountain Petroleum Technology Conference, Apr. 14-16, 2009, Denver, Colorado. [Abstract and introduction only].

(Continued)

*Primary Examiner* — Jennifer H Gay
(74) *Attorney, Agent, or Firm* — Cantor Colburn LLP

(57) ABSTRACT

An apparatus positionable along a downhole string. The apparatus includes a flexible structure retained on a surface of the string in a first condition. The flexible structure movable by a flow to substantially fill an annular space between the string and a radially positioned structure in a second condition. A method of diverting fracturing treatments in a wellbore is also included.

18 Claims, 2 Drawing Sheets

(56) References Cited

OTHER PUBLICATIONS

Clem et al. "The Science Behind Erosion Qualification Testing of Frac Pack Tools," SPE Deepwater Drilling and Completions Conference, Oct. 5-6, 2010, Galveston, Texas, USA. [Abstract and Introduction Only].

International Search Report and Written Opinion; Date of Mailing Oct. 10, 2012; International Appln No. PCT/US2012/029459; Korean Intellectual Property Office; International Search Report 5 pages; Written Opinion 4 pages.

* cited by examiner

HYDRAULIC FRACTURE DIVERTER APPARATUS AND METHOD THEREOF

BACKGROUND

In recent technology related to downhole drilling and completion, fracturing has become more prevalent. Fractures are created mostly from pressure, however sometimes there will be proppant in the slurry used to pressurize the well and that proppant flows into the fractures once open to maintain the fractures in an open condition. Conventionally, hydraulic-set or swelling packers have been used to divert such proppant, however these can be complicated and subject to failure. Since causing and maintaining fractures to be preferentially in zones of interest is desirable, the art is always receptive to new concepts related thereto.

BRIEF DESCRIPTION

An apparatus positionable along a downhole string, the apparatus includes a flexible structure retained on a surface of the string in a first condition, the flexible structure movable by a flow to substantially fill an annular space between the string and a radially positioned structure in a second condition.

A method of diverting fracturing treatments in a wellbore, the method includes positioning a downhole apparatus along a string in a wellbore, the apparatus including a flexible structure retained on an outer surface of the string in a first condition; introducing a flow into the wellbore and towards the structure; at least partially swabbing off the structure by the flow; and, moving the flexible structure by the flow and substantially filling an annular space between the pipe string and the wellbore in a second condition.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
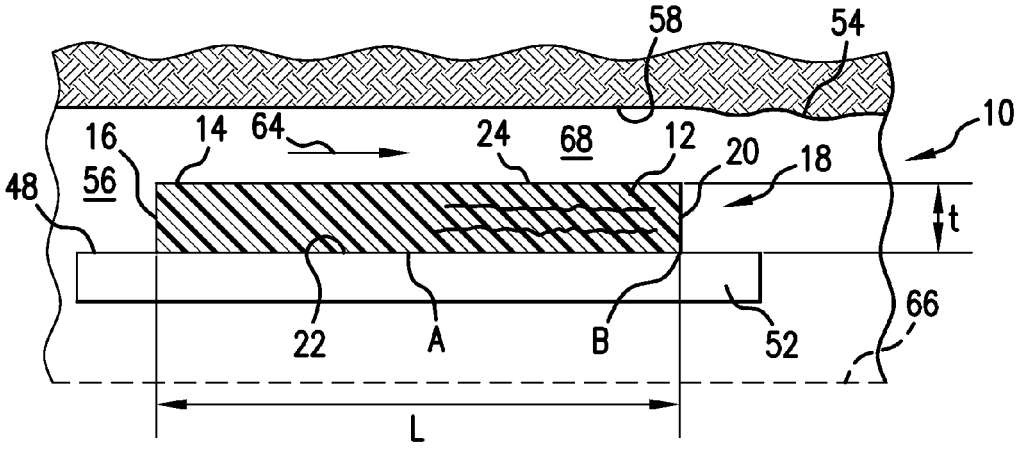
FIG. 1 is a cross-sectional view of an exemplary embodiment of a hydraulic fracture diverter apparatus on a portion of a pipe string.

With reference to FIG. 1, a pipe string 52 is shown positioned within a wellbore 54. The pipe string 52 includes an outer surface 48 spaced from a formation face 58 of the wellbore 54, and a first annulus 56 is formed between the pipe string 52 and the formation face 58 of the wellbore 54. In a non-plugged condition, flow 64 is able to pass through the first annulus 56, past the pipe string 52 within the wellbore 54.

In one exemplary embodiment, a hydraulic fracture diverter apparatus 10 includes a substantially flexible cylindrical or tubular element 12. The element 12 includes a first end 14 adjacent a first end face 16 and a second end 18 adjacent a second end face 20. The first end 14 may be an upstream end where the first end face 16 faces the flow 64 and the second end 18 may be a downstream end. In one exemplary embodiment, the element 12 may be reversibly positioned on the pipe string 52. In another exemplary embodiment, the upstream and downstream ends may be different such that the element 12 may not be reversibly oriented for proper use. The element 12 also includes an inner surface 22, which may be substantially tubular shaped, and an outer surface 24, which may also be substantially tubular shaped, where the outer surface 24 has a larger outer radius than an inner radius at the inner surface 22. A thickness t of the element 12 may be a difference between the outer radius and the inner radius. In one exemplary embodiment, the thickness t may be constant throughout a length L of the tubular element 12, however in another exemplary embodiment, the thickness t may be different in one section of the tubular element 12 than in another section of the tubular element 12 for controlling liftoff behavior, such as the thickness near the upstream end being thinner than the thickness near the downstream end.

The element 12 is retained on the outer surface 48 of a portion of the pipe string 52, adjacent a zone of interest 60 within the wellbore 54 where fractures are to be maintained and/or diversion of fracturing treatments is desired. The pipe string 52, flexible element 12, first annulus 56, and the formation face 58 of the wellbore 54 are substantially concentrically arranged about a longitudinal axis 66. While the element 12 fills a portion of the first annulus 56, a second annulus 68 remains between the outer surface 24 of the element 12 and the formation face 58 of the wellbore 54. The second annulus 68 is thinner than the first annulus 56 by the thickness t of the element 12. A flow 64 is capable of passing through the wellbore 54 via the second annulus 68 in an initial state or first condition, or at a first flow velocity, because the wellbore 54 is not plugged in this initial state in the vicinity of the element 12.

In an exemplary embodiment, and in the first condition, the element 12 may be retained on the pipe string 52 by elasticity, such that an inner diameter of the inner surface 22 of the element 12 may be less than an outer diameter of the outer surface 48 of the pipe string 52 prior to installation of the element 12 upon the pipe string 52. In another exemplary embodiment, a portion of the element 12 may be retained on the pipe string 52 by adhesive or other securement devices. In an exemplary embodiment employing an adhesive, the adhesive may be applied between the outer surface 48 of the pipe string 52 and the inner surface 22 of the element 12 along an entire length L of the element 12, in one exemplary embodiment, or along a first section, such as between points A and B, in another exemplary embodiment, where point A indicates a point where the element 12 is encouraged to remain on the pipe string 52 and swab off is discouraged. Similarly, a securement device may be positioned at point A to encourage the element 12 to remain on the pipe string 52 at point A and swab off is discouraged.

Figure 2:
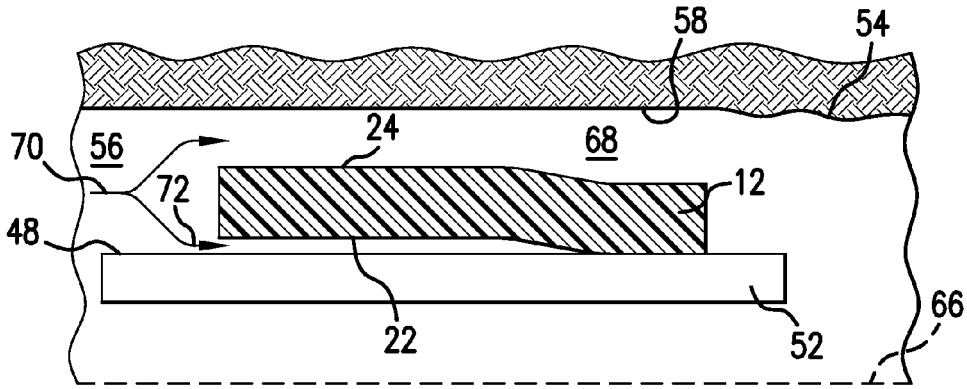
FIG. 2 is a cross-sectional view of the exemplary hydraulic fracture diverter apparatus of FIG. 1 experiencing lift off within a flow.

Turning now to FIG. 2, when the pipe string 52 is placed in the wellbore 54 and is subjected to flow 70 of sufficient intensity in the first annulus 56 between the outer surface 48 of the pipe string 52 and the formation face 58 of the wellbore 54, the element 12 is swabbed off or at least partially swabbed off of the outer surface 48 of the pipe string 52. That is, flow 70 over the outer surface 48 of the pipe string 52 and towards the first end face 16 of the element 12 urges lift off of element 12 from the pipe string 52 completely or partially, which may also be termed swabbing. When the element 12 begins to lift off, the flow 72 starts to get in between the inner surface 24 of the element 12 and the outer surface 48 of the pipe string 52, which encourages further lift off. In an exemplary embodiment where an adhesive or other securement device is applied at point A, lift off may be discouraged at that point. In an exemplary embodiment where adhesive is placed along the entire length L of the element 12, the flow velocity would have to be increased in order to swab off the element 12 from the pipe string 52.

Figure 3:
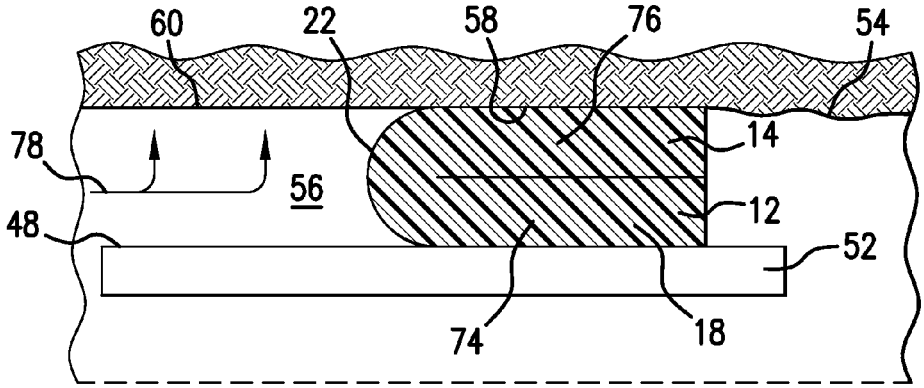
FIG. 3 is a cross-sectional view of the exemplary embodiment of the hydraulic fracture diverter apparatus of FIG. 1 after it has been forced into plugging the wellbore.

As shown in FIG. 3, the swabbing process lifts and folds the element 12 into forming a restriction in the first annulus 56. That is, a first section 74 of the tubular element 12 is folded over onto a second section 76 of the tubular element 12. Inner surface 22 of the element 12 may then make contact with formation face 58 of wellbore 54 and the first end 14 may become adjacent to the second end 18, making a central portion of the element 12 the upstream end. When the element 12 forms a restriction or plug, this restriction urges the flow of fracturing treatments, indicated by arrow 78, against the formation face 60 rather than farther along the first annulus 56. This restriction in flow may cause a build up of pressure great enough to allow fractures to initiate in the wellbore 54, and the flow of slurry including proppant may then be diverted, such that a flow of a fracturing treatment is diverted into a fracture as indicated by arrow 78.

Figure 4:
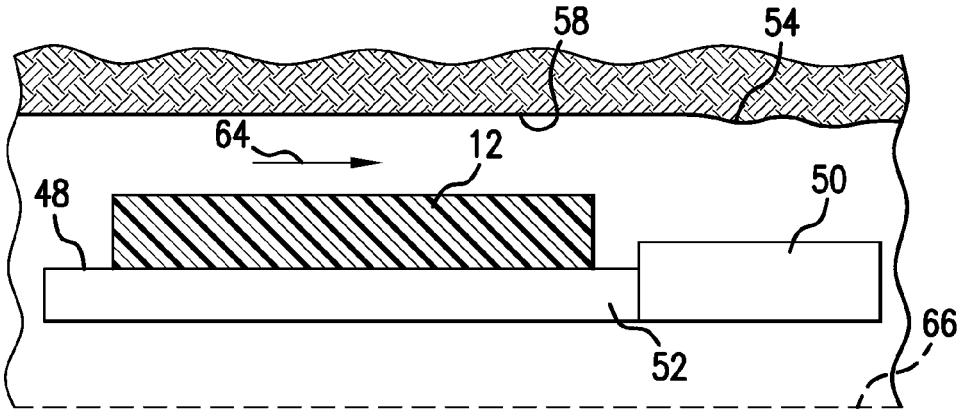
FIG. 4 is a cross-sectional view of an exemplary embodiment of a hydraulic fracture diverter apparatus on a portion of a pipe string adjacent a pipe joint.
Figure 5:
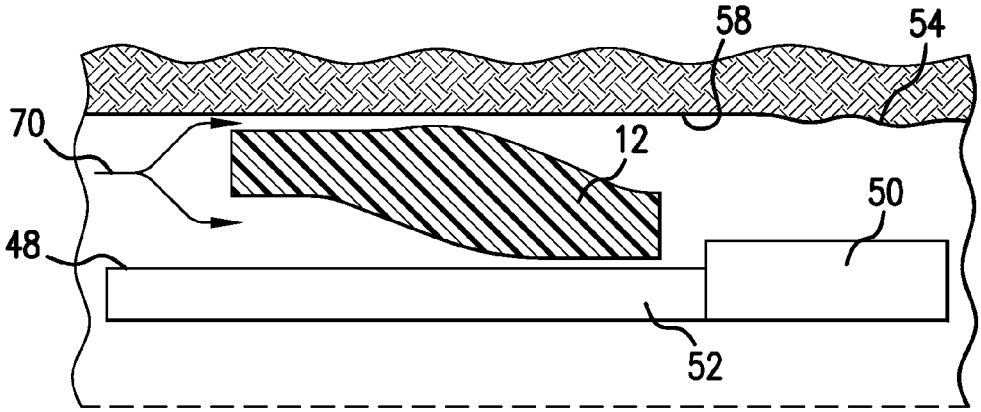
FIG. 5 is a cross-sectional view of the exemplary hydraulic fracture diverter apparatus of FIG. 4 experiencing lift off within a flow; and, FIG. 6 is a cross-sectional view of the exemplary embodiment of the hydraulic fracture diverter apparatus of FIG. 4 after it has been forced into plugging the wellbore.
Figure 6:
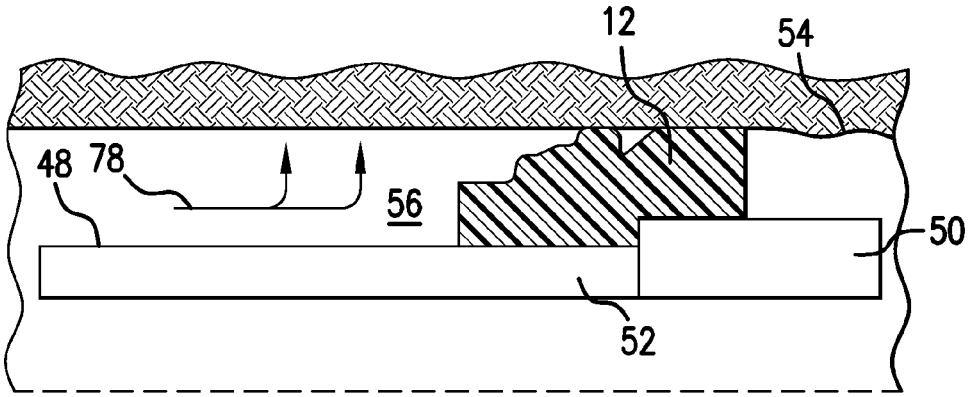

FIGS. 4-6 show another exemplary embodiment of a substantially tubular element 12 employed on pipe string 52 within a wellbore 54. The element 12, pipe string 52, and wellbore 54 are substantially the same as in FIGS. 4-6, and therefore common elements will not be described again. In the exemplary embodiment shown in FIGS. 4-6, the element 12 may be completely unbonded on the outer surface 48 of the pipe string 52 by the flow 70 and then caught in a partially restricted area downstream, such as at an upset or at a tool joint or pipe joint 50. The material of the element 12 may be selectively chosen to achieve this effect, such as an easily deformable elastomer. After the element 12 is caught at the restricted area, the tubular element 12 may be longitudinally squashed, compressed, and otherwise deformed to substantially fill in the annular space 56.

How quickly fracturing treatment is diverted to the area of interest 60 will depend on how quickly the first annulus 56 is plugged by the element 12. If the diversion of fracturing treatment is to be delayed for a certain time period, then the flow 64 past the element 12 can be relatively slow enough not to immediately lift off the element 12 from the pipe string 52, or the element 12 may be sufficiently retained, adhered, or secured to the pipe string 52 so as not to be readily swabbed off, or a combination of a slower flow 64 and an adequately retained element 12 may be employed. On the other hand, if the diversion of fracturing treatment is desired to occur as quickly as possible, then the flow 70 may be hastened towards and past the element 12 to quickly initiate liftoff, or the element 12 may be designed so as not to cling too tightly to the pipe string 52, or a combination of a quicker flow and a relatively loosely fitted element 12 may be employed.

The element 12 on the outer surface 48 of the pipe string 52 may be constructed in a variety of ways to achieve the desired liftoff behavior. It can be fully or partially bonded to encourage liftoff above a certain flow regime, and its stiffness can be varied axially to the same effect. The design and retention of the element 12 will dictate the repeatability and effectiveness of the "swab off" behavior as a fracturing diverter. Any of the above described or below mentioned techniques or combinations thereof are within the scope of these embodiments. In exemplary embodiments, the element 12 may be constructed from an elastomer and a thickness, length, and stretch over the outer surface 48 of the pipe string 52 may be selected so that low flow rates allow it to remain in place, but higher flow rates cause "liftoff". In other exemplary embodiments, the elastomeric properties along the length of the element 12 may be varied to encourage liftoff at the desired rate. In yet other exemplary embodiments, reinforcing materials may be embedded in the element 12 to further control the liftoff behavior. In still other exemplary embodiments, the element 12 may be bonded or partially bonded to control the liftoff and post-liftoff behavior (encourage folding, for example). In still other exemplary embodiments, a portion of the element 12 may be mechanically retained to control liftoff and post-liftoff shape (clamps, bands, interference fits, etc.) And in yet other exemplary embodiments, an upset or a plurality of upsets may be placed in the first annulus 56 downstream of the element 12 to act as backup or to encourage a specific post liftoff shape.

An element has been described wherein flow changes the position and/or the shape of the element so that the element in a first condition allows the flow to pass and in a second condition acts as a restrictor to the flow. Although the element has been described as blocking the flow within a wellbore, it should be understood that the element may function regardless of what annulus it is positioned in, including a casing that is within a wellbore, or within an inner diameter of a string which could cause an automatic restriction if fluid flow velocity exceeded a threshold velocity, or be used in other downhole endeavors such as CO2 sequestration for example. Also, while the element has been described primarily as a tubular member, in other exemplary embodiments, the element may not be tubular for various applications such as when flow is to be directed at one portion of the annulus for example, or the element may be one of a number of parts that together form the annular restriction when lifted off the string.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. An apparatus positionable along a downhole string, the apparatus comprising:

a flexible structure retained on a surface of the string in a first condition, the flexible structure movable by a flow to substantially fill an annular space between the string and a radially positioned structure in a second condition;

wherein the flexible structure is a tubular structure and includes an inner diameter smaller than an outer diameter of the string in an unstretched condition of the tubular structure.

2. The apparatus of claim 1, wherein the flexible structure in the first condition is retained on outer surface of the string by elasticity within a flow of a first intensity.

3. The apparatus of claim 2, wherein the flexible structure is swabbed off of the pipe string within a flow of a second intensity greater than the first intensity to move the flexible structure into the second condition.

4. The apparatus of claim 1, further comprising a securement securing the structure to the string.

5. The apparatus of claim 4, wherein the securement includes an adhesive positioned between a first section of the tubular structure and the string.

6. The apparatus of claim 5, wherein a second section of the tubular structure is not adhered to the string, and the second section is adapted to swab off of the string and fold over onto the first section in a flow of sufficient intensity to substantially fill the annular space in the second condition.

7. The apparatus of claim 1, further comprising an upset positioned downstream of the flexible structure, the upset forming a restricted area in the annular space in which the flexible structure is caught in the second condition.

8. The apparatus of claim 7, wherein the upset is a pipe joint.

9. The apparatus of claim 1 wherein the flexible structure includes varied axial stiffness.

10. The apparatus of claim 1, wherein the flexible structure includes reinforcing materials embedded therein to control liftoff behavior.

11. The apparatus of claim 1, wherein the flexible structure includes an elastomer.

12. The apparatus of claim 1, wherein the flexible structure is folded over onto itself in the second condition.

13. The apparatus of claim 1, wherein the flexible structure is longitudinally squashed in the second condition.

14. A method of diverting fracturing treatments in a wellbore, the method comprising:

positioning a downhole apparatus along a string in a wellbore, the apparatus including a flexible structure retained on an outer surface of the string in a first condition, the flexible structure being a tubular structure including an inner diameter smaller than an outer diameter of the string in an unstretched condition of the tubular structure;

introducing a flow into the wellbore and towards the flexible structure;

at least partially swabbing off the flexible structure by the flow; and, moving the flexible structure by the flow and substantially filling an annular space between the pipe string and the wellbore in a second condition.

15. The method of claim 14, subsequent moving the flexible structure and substantially filling the annular space, further comprising diverting flow including proppant into a formation of interest along a formation face of the wellbore.

16. The method of claim 14, wherein moving the flexible structure by the flow includes folding a first section of the flexible structure onto a second section of the flexible structure.

17. The method of claim 14, wherein moving the flexible structure by the flow includes catching the flexible structure downstream on an upset.

18. The method of claim 14, wherein moving the flexible structure includes longitudinally squashing the flexible structure by the flow.

* * * * *